United States Patent [19]

Wilson et al.

[11] Patent Number: 5,022,200

[45] Date of Patent: Jun. 11, 1991

[54] INTERLOCKING SECTIONS FOR PORTABLE FLOORS AND THE LIKE

[75] Inventors: Kermit H. Wilson, Edina; Warren Skistad, Madison Lake, both of Minn.

[73] Assignee: Sico Incorporated, Minneapolis, Minn.

[21] Appl. No.: 442,837

[22] Filed: Nov. 29, 1989

Related U.S. Application Data

[62] Division of Ser. No. 216,818, Jul. 8, 1988, abandoned.

[51] Int. Cl.[5] ..... E04B 2/82

[52] U.S. Cl. ..... 52/127.9; 52/584; 52/589; 52/593

[58] Field of Search ..... 52/127.9, 127.11, 584, 52/589, 591, 593, 594; 70/142; 292/27, 29, 37, 34, 165, 193, 239

[56] References Cited

U.S. PATENT DOCUMENTS

| | | | |
|---|---|---|---|
| 369,478 | 9/1887 | Snow . | |
| 876,912 | 1/1908 | Pike . | |
| 1,175,316 | 3/1916 | Solon . | |
| 2,021,922 | 11/1935 | Peck . | |
| 2,115,936 | 5/1938 | Sterns . | |
| 2,142,305 | 1/1939 | Davis . | |
| 2,217,781 | 10/1940 | Wiley . | |
| 2,340,864 | 2/1944 | Carpenter | 52/127.9 |
| 2,377,211 | 5/1945 | Cocken, Jr. . | |
| 2,822,585 | 2/1958 | Baruch . | |
| 2,885,039 | 5/1959 | MacFarland | 52/127.11 |
| 3,141,392 | 7/1964 | Schneider et al. . | |
| 3,191,726 | 6/1965 | Pavlecka . | |
| 3,239,986 | 3/1966 | Russell . | |
| 3,248,995 | 5/1966 | Meyer . | |
| 3,280,522 | 10/1966 | Palfey | 52/585 X |
| 3,310,910 | 3/1967 | Bue et al. | 52/127.11 |
| 3,310,919 | 3/1967 | Bue et al. . | |
| 3,385,183 | 5/1968 | Kortz . | |
| 3,400,958 | 8/1968 | Haimes | 52/127.9 |
| 3,496,692 | 2/1970 | Melcher | 52/127.9 X |
| 3,500,606 | 3/1970 | Wharmby . | |
| 3,567,260 | 3/1971 | Norris . | |
| 3,599,385 | 8/1971 | LaRue . | |
| 3,720,027 | 3/1973 | Christensen | 52/589 X |
| 3,785,103 | 1/1974 | Turner | 52/127.9 X |
| 3,826,056 | 7/1974 | Smith et al. . | |
| 3,890,753 | 6/1975 | Johansen . | |
| 4,045,927 | 9/1977 | Diaz . | |
| 4,057,948 | 11/1977 | Wise . | |
| 4,144,681 | 3/1979 | Leffler et al. . | |
| 4,402,167 | 9/1983 | Denucci | 52/127.9 X |
| 4,465,398 | 8/1984 | Knudsen . | |
| 4,512,122 | 4/1985 | Berkowitz | 52/584 X |
| 4,538,392 | 9/1985 | Hamar et al. . | |
| 4,693,630 | 9/1987 | Giovannetti | 52/127.9 X |

FOREIGN PATENT DOCUMENTS

| | | |
|---|---|---|
| 486349 | 3/1976 | Australia . |
| 2248892 | 4/1974 | Fed. Rep. of Germany . |
| 2448880 | 4/1976 | Fed. Rep. of Germany . |
| 1347862 | 1/1964 | France . |
| 89184 | 5/1967 | France . |
| 2445461 | 7/1980 | France . |

*Primary Examiner*—Richard E. Chilcot, Jr.
*Assistant Examiner*—Joanne C. Downs
*Attorney, Agent, or Firm*—Merchant, Gould, Smith, Edell, Welter & Schmidt

[57] ABSTRACT

Interlocking sections for portable floors and the like have a floor section (10) having interlocking members set in molded urethane (15) for connections along the edges of the floor sections (10). The interlocking members latch a male member (50) and a female member (70) fitting into recesses along the edges of the floor section (10) and are molded into place. The female locking member (70) has a central slot (85) receiving a flange (60) of the male locking member (50). Slots (81*a*, 81*b*) and (100*a*, 100*b*) and springs (90, 91) guide motion of pins (80*a*, 80*b*) which engage the flange (60). A release mechanism (120) actuated by an Allen key wrench has a cam member (121) which engages the springs (90, 91) to release the male locking member (50).

12 Claims, 7 Drawing Sheets

INTERLOCKING SECTIONS FOR PORTABLE FLOORS AND THE LIKE

This is a division of application U.S. Ser. No. 07/216,818, filed July 8, 1988.

FIELD OF THE INVENTION

This invention relates generally to interconnectable sections and improved locking means therefor whereby sections can be secured together in edge-to-edge relationship. Examples include interlocking floor sections for a portable floor which can be assembled together to form an extended floor area, or which can be taken apart for storage.

BACKGROUND OF THE PRIOR ART

Portable floors, consisting of a number of interlocking sections, are used for providing a temporary hard surface floor which may be set up over carpeting or other surfaces on a temporary basis by joining a number of floor sections together in edge-to-edge relationship. Locking or connecting means are provided along the edges to secure adjacent sections together during use. For storage, the locking means are released or otherwise disconnected so that the sections can be disassembled for storage. One feature of the present invention is the provision of an improved locking means for connection of such sections. While the locking means of this invention is applicable to edge-to-edge joining of interlocking panels or sections for a wide variety of purposes, since the presently preferred embodiment of the invention is in connection with portable floors, the specification and drawings in this patent application are directed to that particular use.

Portable floors are used, for example, in the hospitality and entertainment industries when it is desired to temporarily provide a smooth hard surface for dancing or other activities. Portable floors may be set up over carpeted floor or other surfaces by connecting together in edge-to-edge fashion a plurality of floor sections. The sections are releasably locked together along their edges to produce an extended floor area of the desired size. A portable floor of this general type is disclosed in U.S. Pat. No. 3,310,919, assigned the assignee of the present invention. In that patent, floor panels are provided, each having a metallic tongue section along certain edges and a metallic groove section along certain other edge, such that adjoining sections can be fitted together in edge-to-edge relationship by tongue-and-groove arrangement, and held in place by locking screws threaded through to engage notches in the tongue members. While the portable floor disclosed in that patent has been successful in providing a convenient and efficient portable floor, the present invention provides ar improved interlock system and construction which are believed to be advantageous.

It would be desirable to have an interlock system for floor sections that automatically locked or snapped into engagement whenever the corresponding edges were pushed into contact, without having to require an operator to perform an additional task such as tightening down a set screw. However, in order to be acceptable for a dance floor section application, an interlocking means must meet a number of rather stringent criteria. The locks must reliably and positively engage when sections are pushed together, so that there will be no possibility of sections which "look" locked but which in fact are not. The locking means must operate reliably under adverse conditions, including operating for year after year despite the probability that dust, dirt and other debris will work itself into the lock, and despite predictable rough handling and even abuse during the operations of setting up and taking down the floor. With regard to rough handling, if a workman were to try to lift up one section while it is still latched to a number of others, a situation which is not recommended but which would probably occur from time to time, the interconnecting means would be subject to tremendous bending or twisting forces, given the magnitude of the forces applied through considerable leverage. These factors of required reliability in the face of a difficult operating environment have ruled out known practical latch-type mechanisms.

SUMMARY OF THE INVENTION

The present invention overcomes these problems by providing an improved locking mechanism which may be advantageously used in edge-to-edge connectors for floor sections or other types of interconnecting members requiring reliable and strong connections. According to one aspect of the invention, there is provided an improved locking mechanism including first and second members which fit together for locking purposes. The second lock member has pins mounted therein for motion along defined paths between first and second positions, referred to herein as closed and open positions. Means, for example resilient means, are provided for normally urging the pins to their closed positions. The first lock member has means for moving the pins to their open positions when the two lock members are moved together, and for permitting the pins to return to their closed positions after engagement of the first and second lock members. The first lock member has engagement surfaces which contact the pins when forces are applied to move the first and second lock members apart. The shape or slope of these engagement surfaces relative to the paths of defined motion of the pins is such as to cause substantial interference of the first lock member with the pins which prevents movement of the pins to their open position and therefore prevents removal of the lock member. A separate unlocking mechanism is provided to move the pins to their open position and thereby permit disengagement of the mechanism. According to a preferred embodiment of the invention, the first lock member includes a flange and the second lock member includes means defining a recess to receive the flange. The pins are positioned generally within the receiving space, and the flange includes surfaces on its outer edge for moving the pins to their open position, and hook-like portions having the engagement surfaces which engage the pins in the locked position.

According to another aspect of the invention, an improved panel construction is provided in which a panel is formed in a single molding process which encapsulates a core member in urethane, molds the edge tongue and groove portions with recesses formed therein to receive the locking members, and bonds the decorative and durable floor surface.

BRIEF DESCRIPTION OF THE DRAWINGS

In the drawings, in which like reference numerals indicate corresponding parts throughout the several views.

DETAILED DESCRIPTION OF THE PREFERRED EMBODIMENT

As mentioned above, a preferred application of the locking means of the present invention is in the edge-to-edge locking mechanism for interlocking floor sections for a portable floor. Prior to describing the construction and operation of the locking mechanisms in detail, an improved floor section according to one aspect of the invention, with which the locking mechanism may be used, will be described with reference to FIGS. 10–14.

Figure 10:
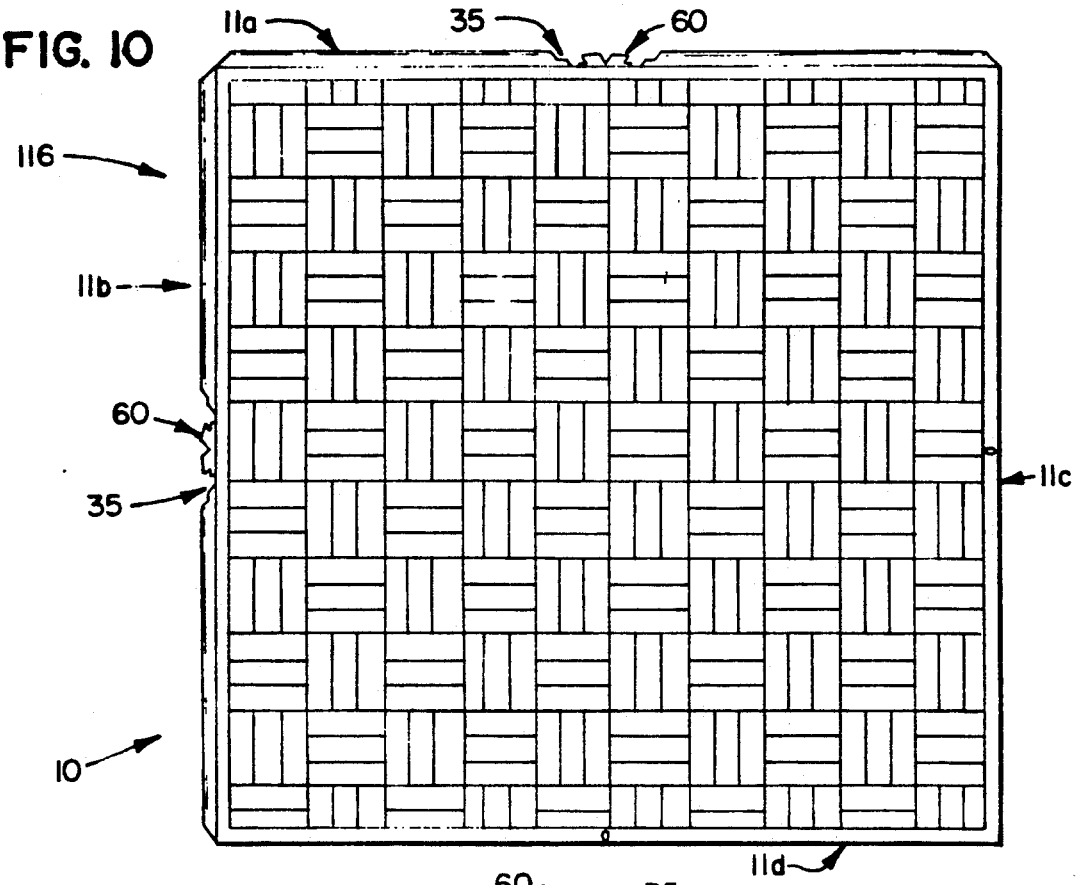
FIG. 10 is a top plan view at a much reduced scale of a single floor section according to the invention, with which the locking means of FIG. 1 can be used.
Figure 11:
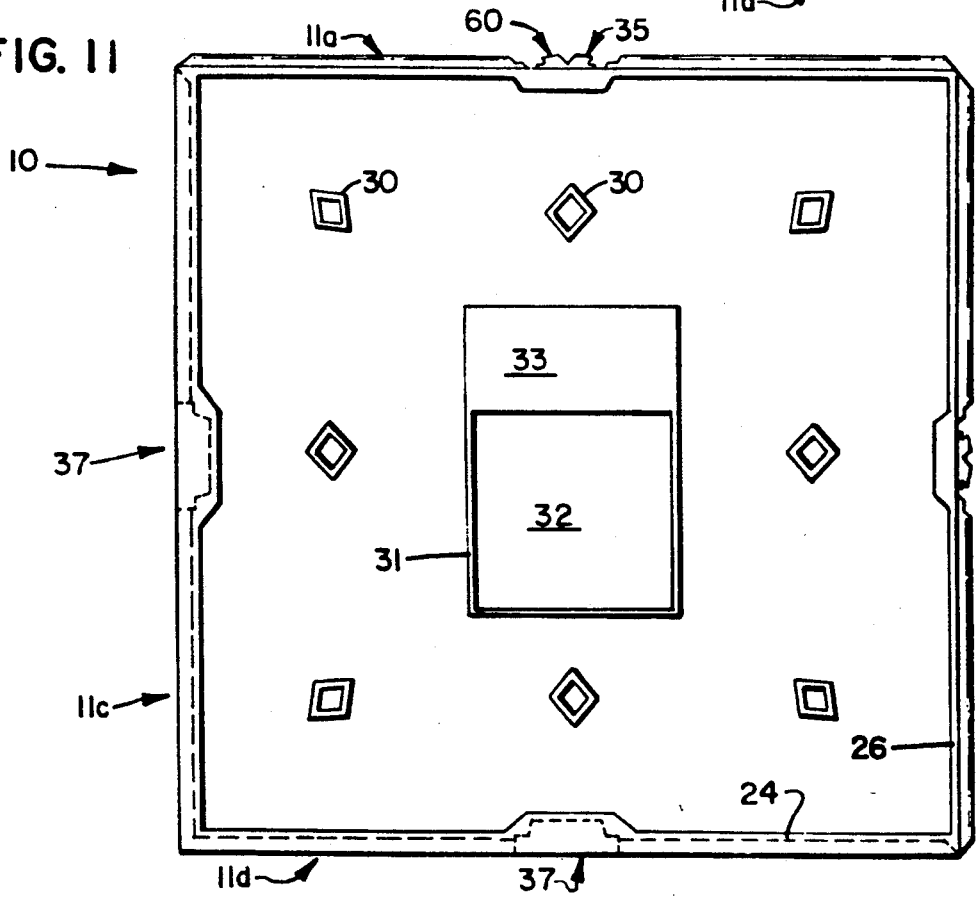
FIG. 11 is a view of the underside of the section of FIG. 10.

As seen in FIG. 10, floor section 10 is a square, flat panel. It will be understood, however, that a square configuration is not required, but that a rectangular or other polygonal form could be used; however, a square section is believed to be preferable in terms of ease of use and manufacture. Section 10 has edges designated 11*a*, 11*b*, 11*c* and 11*d*, respectively. Edges 11*a* and 11*b* are tongue-type edges which would include first locking members, and edges 11*c* and 11*d* are groove-type edges which would include second locking members. The tongue and the groove edges are complementary to one another, as are the first and second locking members, so that a plurality of panels such as the one in FIG. 10 can be connected together in edge-to-edge relationship, with tongue sections connecting with groove sections, and with the first and second locking members locked together as described hereinafter.

With reference to FIGS. 10–14, a floor section 10 includes a core 12 which is a flat, square panel of approximately the same dimensions as the floor section. Core 12 is preferably made of wood, such as particle board or plywood, although other materials could be used. Core 12 is completely embedded in a urethane-type plastic material 15, in a molding process described below, which encapsulates core 12 and forms the edges of the floor section 10. Complete encapsulation prevents the wood core from absorbing moisture. On the upper surface of the section, lamination sheet 13 is bonded to the urethane. This sheet covers substantially the entire upper surface of floor section 10, except for a band or strip of the urethane material adjacent the edges. Lamination 13 is a high-pressure laminate material having a durable wear surface, which also may contain a decorative pattern such as the parquet pattern indicated in FIG. 10. Laminate 13 has a sanded or roughened back side for maximum adherence to the urethane.

On the bottom side of panel 10 is a backer sheet 14 which is also bonded to the urethane. This sheet may also be a high-pressure laminate material similar to laminate 13, and provides additional strength and stiffness for the panel as well as helping to resist any warpage.

Figure 12:
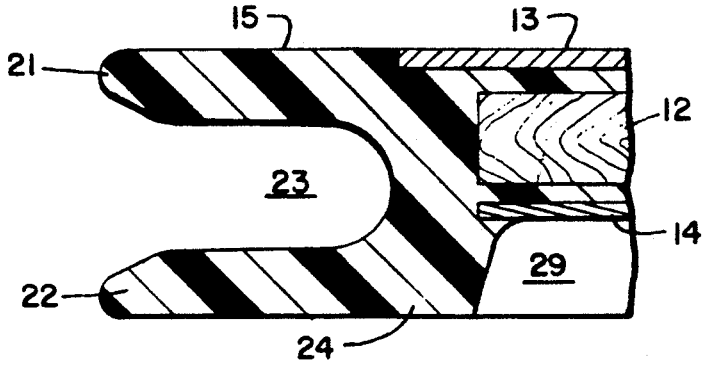
FIG. 12 is a cross-sectional view at an enlarged scale of a groove-type edge, taken generally along line 12—12 of FIG. 10.
Figure 13:
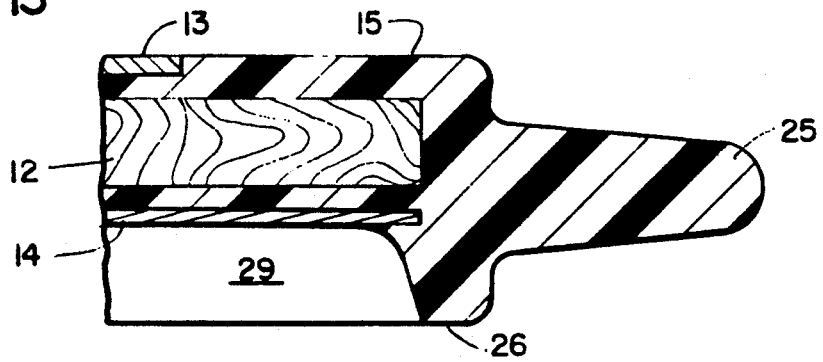
FIG. 13 is a sectional view at an enlarged scale of a tongue-type edge, taken generally along line 13—13 of FIG. 10.

In the preferred embodiment, the edges are formed integrally with the urethane 15 which encapsulates core 12. Groove-type edges 11*c* or 11*d* as seen in the cross-sectional view of FIG. 12 are formed with upper and lower edges 21, 22, respectively, and a groove portion 23 formed therebetween. Lower surface 24 adjacent edge 22 forms a strip or band along the edge for contacting the underlying floor or other surface upon which floor section 10 is placed. Lower surface 24 extends only a certain distance inwardly from the edge, where the contour of the urethane material slopes up to the level of backer sheet 14, forming a recess or hollowed-out area 29 which extends over most of the back side of floor section 10. A number of supports 30 are spaced at intervals around the underside of the floor section, in the form of areas where the urethane material extends down from backer sheet 14 to the level of lower surface 24, to provide floor or ground engagement and additional support. In the preferred embodiment shown in FIG. 11, these supports 30 are in the form of diamond-shaped walled structures, but it will be understood that any size, shape and spacing arrangement can be used. A central support 31 is provided in the form of a roughly rectangular walled structure which also extends to the ground engagement level of lower surface 24. In the preferred embodiment, an interior recess 32 is provided within central support 31, and this forms a convenient place for gluing on an instruction data sheet. A wider support portion 32 of support 31 provides a surface on which a logo or other information (not shown) may be molded in.

In FIG. 12, tongue-type edges 11*a* or 11*b* are shown in cross-section. The edges of top laminate 13, core 12 and backer sheet 14 are seen encapsulated in the urethane material 15, as in the case of the groove-type section. The tongue-type section of FIG. 13 has a large projection 25 formed and sized to be received in groove portion 23. A lower surface 26 is formed adjacent projection 25, and is at the same level as, and performs the same function as, surface 24 of the groove-type edges.

Figure 14:
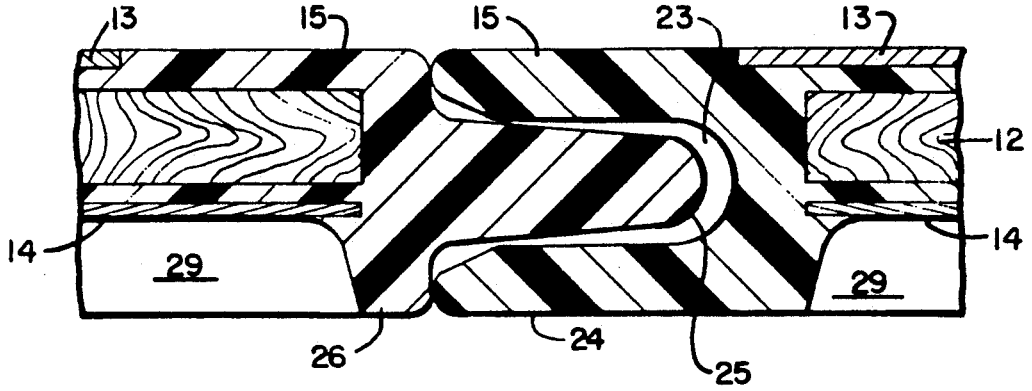
FIG. 14 is a sectional view similar to FIGS. 12 and 13 showing the interlocking of the tongue-and-groove-type edges of adjacent floor sections.

FIG. 14 shows a groove-type edge and a tongue-type edge of two adjoining sections engaged together. This tongue-and-groove arrangement helps provide a degree of stability and security between adjacent sections, in that it substantially prevents relative up and down movements at the edges.

Zones 35 are molded in along the midpoints along tongue-type edges 11*a* and 11*b*. These zones have a recess for receiving the male lock member, described below. At the midpoints along groove-type edges 11*c* and 11*d*, receiving zones 37 are formed in the molded urethane edge to receive the female lock sections described below. Threaded inserts 40 (see FIG. 2) are imbedded in the urethane in the recesses to provide a means for securing the lock members.

As previously mentioned, the preferred floor section shown in the drawings is made in a single-step molding process, using a clamshell-type mold and injection molding techniques. Laminate top 13 is placed face down in a suitably designed mold (not shown), and core 12 is placed on top of it, separated by spacers (not shown) to allow the urethane material to flow between lamination 13 and core 12. Backer sheet 14 is placed above core 12, also separated by spacers so that urethane will flow between the backer and the core. The mold is then closed and the urethane material is injected. Through appropriate design of the inlets and vents, the molten urethane material fills between the top laminate, core and backer, and forms the edges and supports for the floor section. In the preferred embodiment Urylon TM brand urethane material from Urylon Development Inc., Conyers, Ga., is used, but other types of urethane or other plastic materials can be used, the selection being made according to desired physical and mechanical properties.

Figure 1:
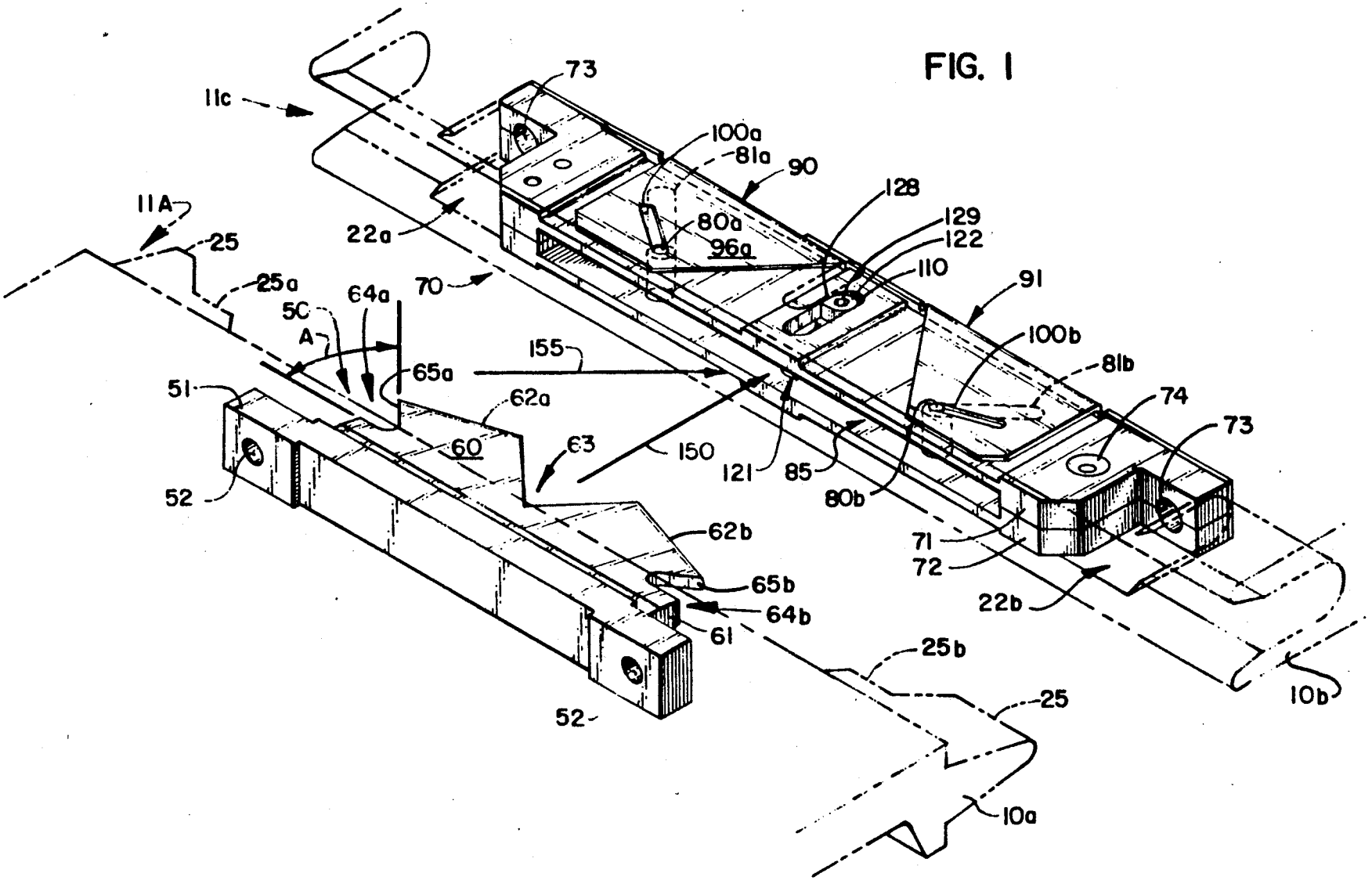
FIG. 1 is a view in perspective of locking means according to the invention, mounted on adjacent edges of floor panels, portions thereof represented in phantom line for purposes of illustration.

Referring now to FIG. 1, male-type and female-type locking members are provided, and are mounted preferably at the midpoint along the edges of a floor section in zones 35 and 37, respectively. In the preferred embodiment, male-type locking members are mounted in the tongue-type edges 11*a*, 11*b*, and female locking members are mounted in the groove-type edges 11*c*, 11*d*. In FIG. 1, two adjacent panels 10*a* and 10*b* are positioned with their edges adjacent one another for locking together. Specifically, tongue-type edge 11*a* of panel 10*a* and groove-type edge 11*c* of panel 10*b* are opposite one another. Edge 11*a* includes a male locking member 50, and groove-type edge 11*c* includes a female locking mechanism 70. For purposes of mounting male lock mechanism 50, a tongue 25 has a gap between the zones indicated by 25*a* and 25*b*, and a portion of the core in between may also be cut away to receive lock member 50. Similarly, a portion of edge 11*c* has a gap to receive female lock portion 70. Specifically, the groove between zones indicated at 22*a* and 22*b* has a gap, and a corresponding portion of the core may be cut back to form the recess for receiving lock mechanism 70. In the preferred embodiment, these gaps or recesses in the edges for receiving the lock members are molded in at the time the panel is made. Alternatively, they could be cut away as by a machining process to form the recesses. This latter process would be preferred if a conventional type panel were used which had aluminum extrusions for the tongue-and-groove edges.

Figure 2:
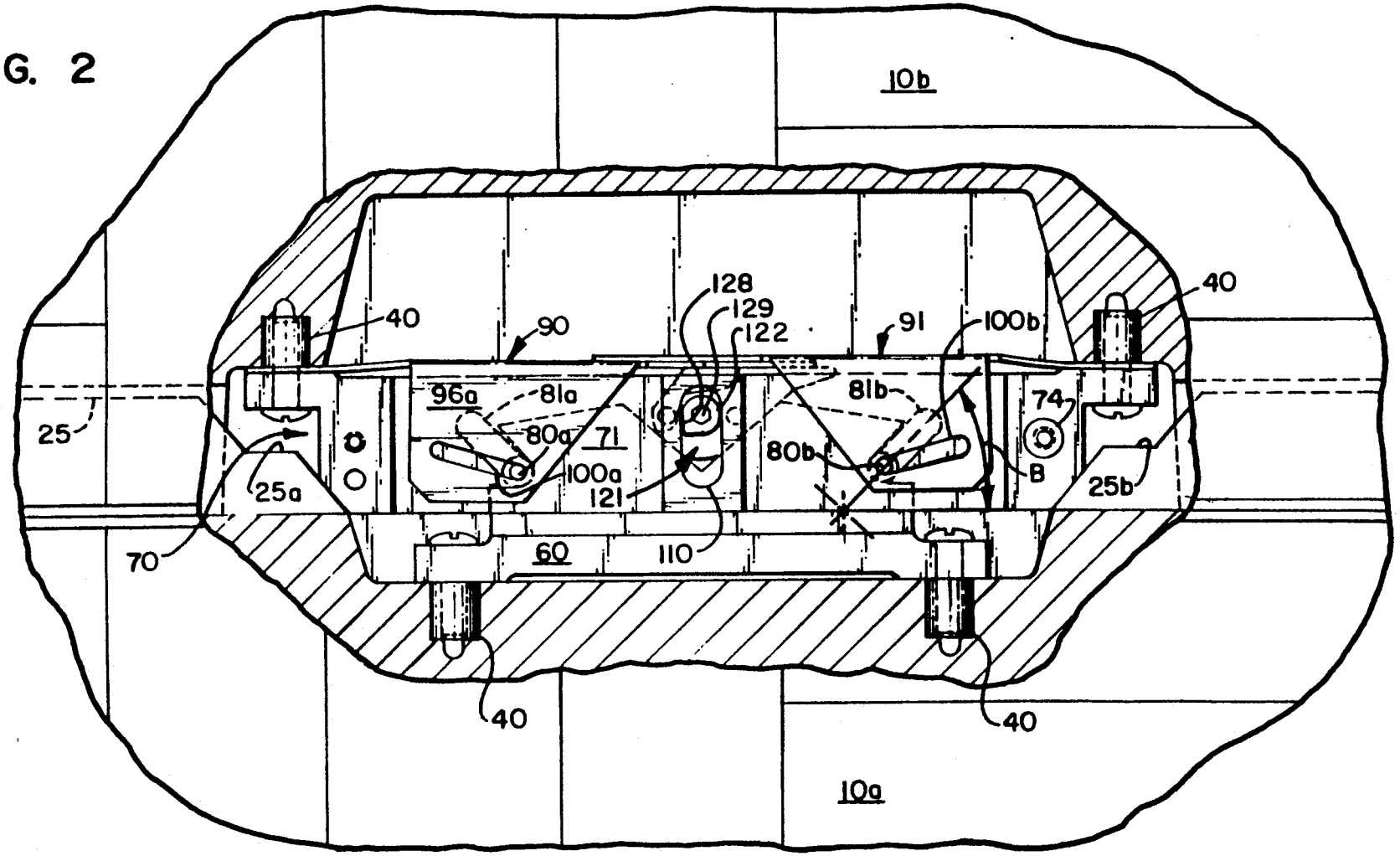
FIG. 2 is a top plan view of a pair of adjacent floor panels connected together with their locking means engaged, portions thereof broken away to show the locking mechanism.

As seen, for example, in FIGS. 1 and 2, male lock member 50 generally includes a base portion 51 and a flange portion 60. The entire male lock member 50 is preferably made from an integral piece of a strong material such as stainless steel by a machining process, or of other material by a powdered metal molding or casting process. The base portion is an elongate generally rectangular member designed to fit into the recess formed in edge 11*a* for that purpose. A pair of mounting holes 52 are provided on either side by means of which screws can be used to secure the male lock member to the threaded inserts 40 of the panel (see FIG. 2). Integral flange portion 60 extends perpendicularly from base portion 51, generally in the plane of the floor section itself. Flange 60 is thinner than base 51, and is somewhat thicker at its root portion 61 than at its forward edges 62*a* and 62*b*. These edges slant backwardly at an angle with respect to the edge of the panel. Between forward edges 62*a* and 62*b* is a notch 63 which provides clearance for the release mechanism, as explained below. Formed on either side of flange 60 are hook portions 64*a*, 64*b* which cut inwardly on flange 60 and which have engagement surfaces 65*a*, 65*b*.

Female lock member 70 is positioned to fit within a recess formed in edge 11*c* of the floor section. Female lock member 70 may be made from the same materials and processes as described above for member 50. Member 70 is in the form of two halves 71, 72 joined together. For convenience of manufacture, halves 71 and 72 can be identical, so that when one is reversed with respect to the other, they will mate to form the frame or shell for the female lock member 70.

Lock member 70 includes a large central slot or recess 85 which is adapted to receive flange 60 of the male lock member 50.

Figure 15:
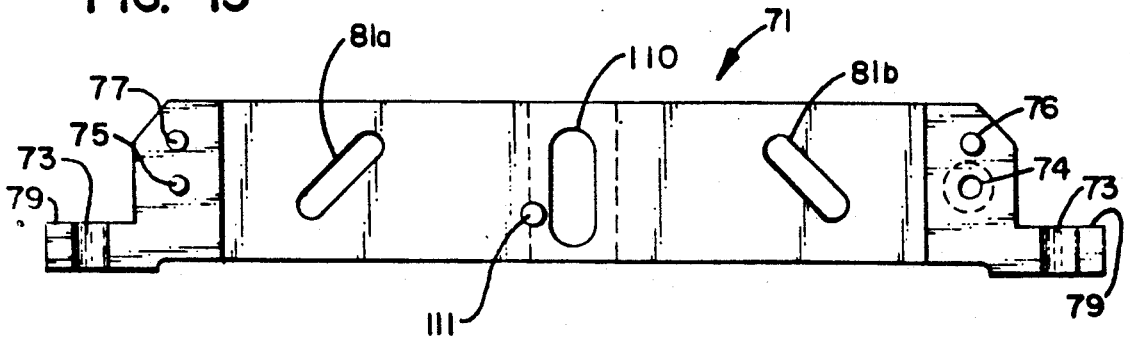
FIG. 15 is a plan view of a portion of the female lock member of the lock of FIG. 1.

One of the halves of female lock portion 70 is shown in FIG. 15. Specifically, half 71 is shown from the inside, i.e., from the side facing inwardly to slot or recess 85. The female lock member and its two halves have tab or extension portions 79 at each end thereof. Holes 73 are formed therein which receive screws which mate with the threaded inserts 40 (FIG. 2) to hold the lock member in the floor panel. At one end is provided a pin 76 and a hole 74, which may be beveled or countersunk at its outside. At the other end in corresponding positions are a hole 77 and a hole 75. The two halves 71, 72 are put together by inserting the alignment pin 76 of each half in the mating hole 77 of the other half. The two halves are secured together with screws fitting through holes 74–75.

As seen in FIG. 1, a pair of pins or rollers 80*a*, 80*b*, are positioned within recess 85 generally in a position to be contacted by flange 60 when it is inserted into the lock position. Ends 80*a*, 80*b* are small cylindrical metallic pieces mounted with their axes transverse to the plane of the floor, and they are positioned within slots 81*a*, 81*b* formed in the top and bottom members 71, 72 of the lock member 70. These slots run at angles with respect to the direction of the edge of the floor section, the significance of which angle is discussed further below. These slots define paths of permitted travel of pins 80*a*, 80*b* therealong.

Figure 4:
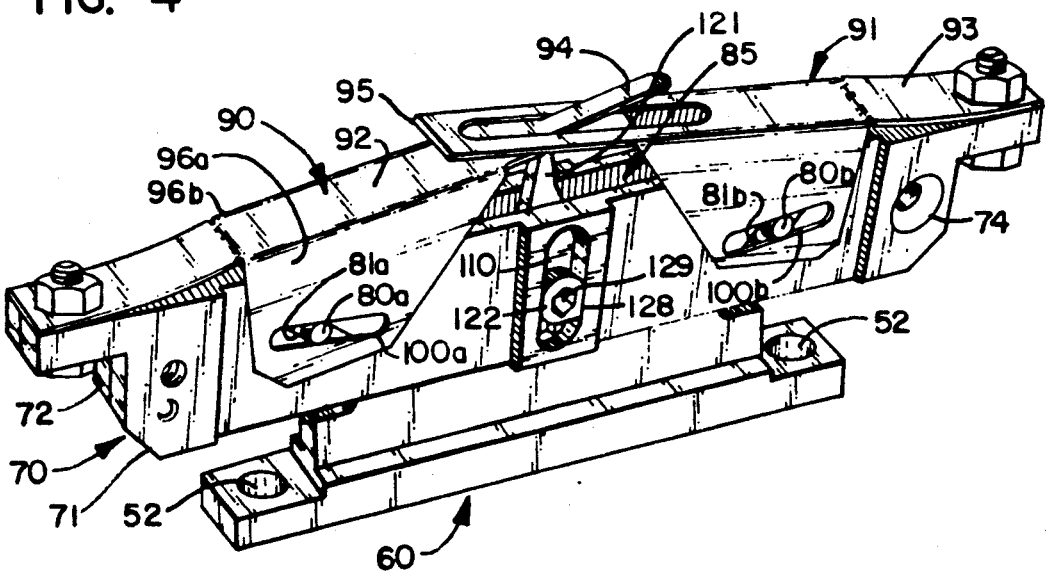
FIG. 4 is a view in perspective of the locking means from a different angle of view than that of FIG. 1, showing the springs and the operation of the release cam.

Female lock member 70 also includes springs 90, 91 positioned along the back side thereof. As seen in FIG. 4, spring 90 includes a back portion 92 which extends along the back of lock member 70 over screw hole 73, and it may be secured thereto by the screw passing through hole 73 which holds the lock member into the floor section. Spring 90 also includes a tip portion 94 which extends slightly beyond the midpoint of the length of the back side of lock member 70. Spring 90 also includes side portions 96*a*, 96*b* which are connected to, or are integrally formed with, spring 90, and which extend as plate-like members along either side of lock member 70 generally over the area which includes slot 81*a*. In order to keep the thickness of lock member 70 to a minimum so that it can fit easily within a recess formed in the edge of the floor section, the side portions of members 71, 72 of lock member 70 have reduced thickness zones to receive portion 96a, 96b of spring 90.

Side portions 96a, 96b have slots 100a formed therein generally in the area over slots 81a, but running at a different angle, the significance of which angle is explained further below in the operations section. In the preferred embodiment, the widths of slots 81a, 81b are wider than the width of slots 100a, 100b and pins 80a, 80b have a reduced diameter extension on either end of a diameter corresponding to the width of slots 100a, 100b. The main body of pins 80a, 80b have a diameter corresponding to slots 81a, 81b. With pins 80a, 80b received in slots 81a, 81b, and the reduced diameter end extensions thereof received in slots 100a, 100b, the pins are retained axially and prevented from falling out of the slots. Motion of pins 80a, 80b in slots 81a, 81b is also dependent upon the flexing of springs 90, 91 so that slots 100a, 100b move to track slots 81a, 81b, as the pins move.

At the other end of female lock member 70, spring 91 similarly has a back portion 93 which is secured to the lock mechanism by the bolt passing through hole 73, and a tip 95 extends beyond the midpoint of the member and overlays a tip portion of spring 90. Tip 95 has a slot formed therein so that tip 94 can pass through tip 95 when both springs are flexed back as indicated, for example, in FIG. 4.

Figure 3:
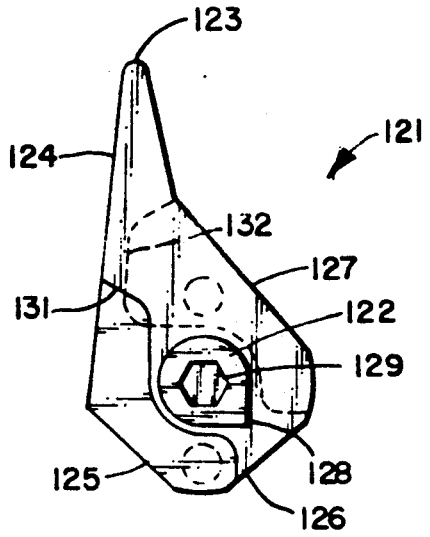
FIG. 3 is a plan view, at an enlarged scale, of a portion of the release, cam of the lock of FIG. 1.
Figure 6:
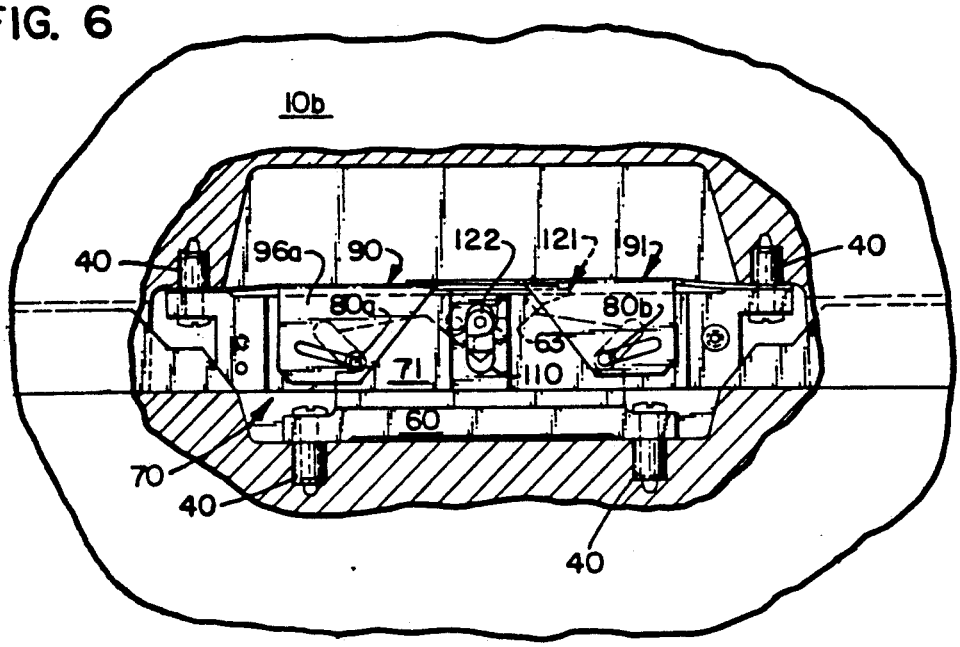
FIG. 6 is a view similar to FIG. 5 showing two sections locked together.
Figure 8:
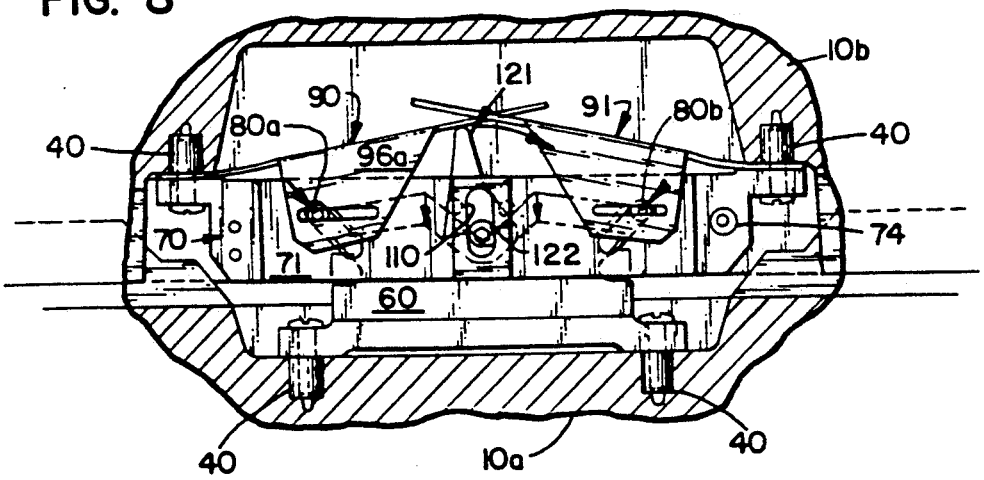
Figure 7:
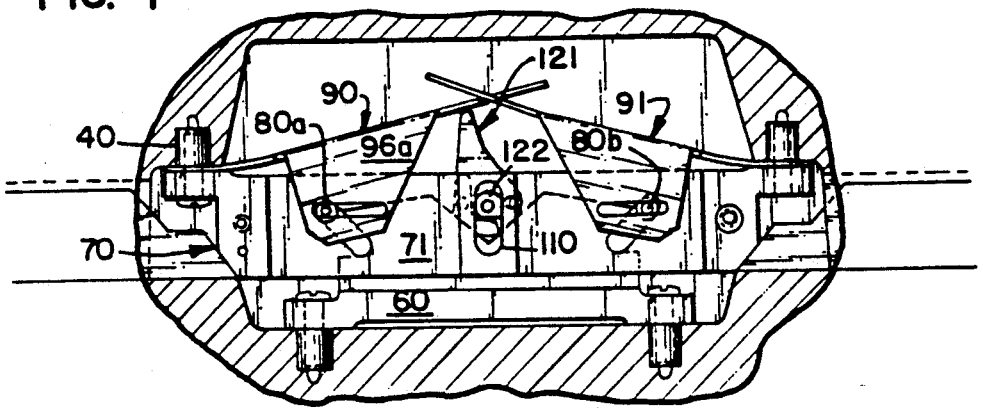

Members 71, 72 also have slots 110 at their midpoints, the slot extending transverse to the direction of the floor section edge. This slot retains the release cam 121 which is used to unlock the latch. As seen in FIG. 15, each side 71, 72 has a pin 111 adjacent slot 110. The release mechanism 120 includes a cam member 121, seen in enlarged detail in FIG. 3. Cam member 121 is made of metal or other durable material and is generally flat and of a thickness to fit within slot 85 between the halves 71, 72 of the female lock member, except for a collar portion 122 which extends above the plane of cam member 121 so that it may fit in slot 110. A similar collar (not shown in FIG. 3) is on the opposite side of cam member 121, and fits in the corresponding slot 110 (not shown in FIG. 1) for the lower member 72 of lock member 70. Cam member 121 has a tip portion 123 which is somewhat elongated, but with a rounded end, for engaging the springs of the lock mechanism, specifically the tip portion 94 of spring 90. Cam member 121 also has a flat surface 124, and three surfaces 125, 126, 127. The angle between surfaces 125–126, and between 126–127 corresponds to the angle of the side surfaces of notch 63 of flange 60 of the male lock member 50, which abuts them in various positions. Collar 122 is generally cylindrical with diameter corresponding to the width of slot 110, except for protrusion 128 which is too big for the width of slot 110 and therefore limits the rotation of cam member 121 to approximately 90°, as can be seen in FIGS. 6–8. Collar 122 has a hex opening 129 for an Allen key wrench. Cam member 121 has a reduced thickness zone with an edge defining cam surface 131. On the opposite side from that shown in FIG. 3, cam member 121 has another reduced thickness zone with an edge defining surface 132.

OPERATION

Prior to engagement of the lock members, springs 90, 91 are in the position shown in FIG. 1, which holds pins 80a, 80b generally in their inward position, as shown in FIG. 1. Cam member 121 of the release mechanism 120 is rotated counter-clockwise, as seen in FIG. 1 (although it would be clockwise if one were to look at the other, or bottom, side of the lock member) with flat surface 124 being positioned parallel to the back edge of the female lock member 70 and in contact with the tip 94 of spring 90, which holds the cam member in that position.

Figure 5:
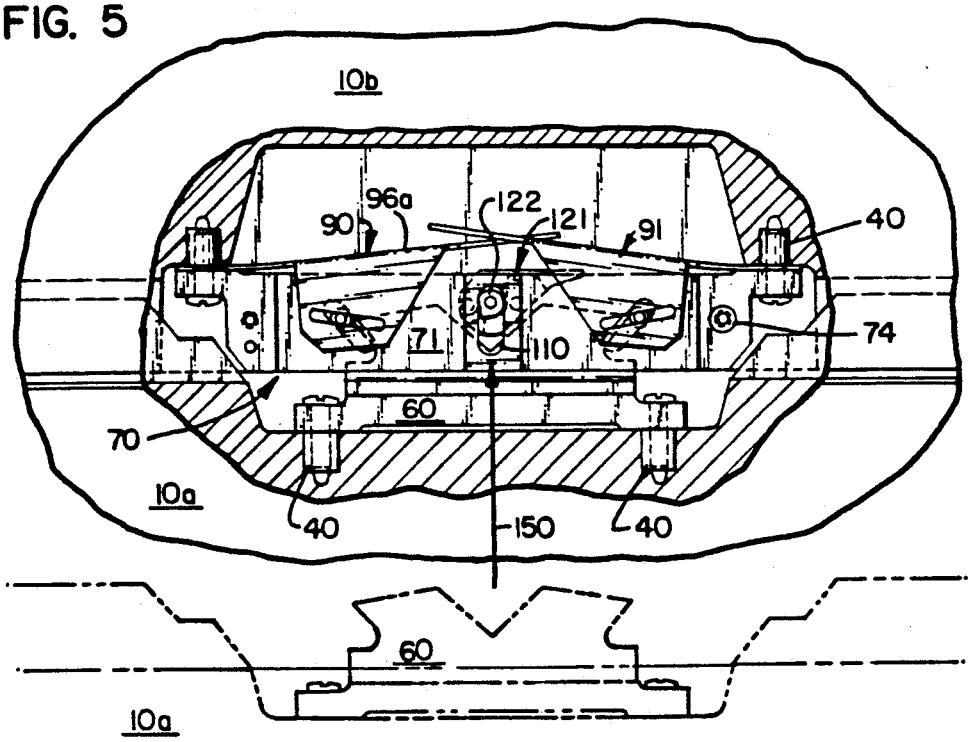
FIG. 5 is a diagram similar to FIG. 2, showing two adjacent sections being brought into locking engagement.

FIG. 1, and also FIG. 5, show arrows 150 suggesting movement of the lock members 50, 70 directly toward one another, i.e., in a direction perpendicular to the direction of the edges 11a, 11c of the floor sections. The members can be brought together in this direction and will latch, as explained below. However, it is important to note also that the members can be brought into engagement by pushing them together with at an angle as suggested by arrow 155 in FIG. 1. This is important, for example, when a number of floor sections have already been put together and another floor section is moved into position into a corner created by two adjacent sections, so that, for example, both sides 11a and 11d and their corresponding male and female lock sections would have to engage at the same time. The new section would be slid into position with its edges generally parallel to the edges of existing floor sections, but the final motion sliding it into place would be such as to bring the lock sections together at an approximately 45° angle. The locking mechanism of this invention will accommodate engagement straight ahead, or at a 45° angle from either side.

As male lock member 50 is moved into engagement with female lock member 70, flange 60 is received in slot 85. Forward edges 62a, 62b of flange 60 engage pins 80a, 80b, respectively, and due to the angles and slopes of edges 62a, 62b and slots 81a, 81b, pins 80a, 80b are moved outwardly and rearwardly along their defined paths of travel in the slots. To do this, springs 90, 91 must flex so that slots 100a, 100b in the springs will track the progress of pins 80a, 80b in slots 81a, 81b. This condition is shown in FIG. 5, in which the two lock members are engaging, but not yet secure, with the pin having ridden outwardly on engagement surfaces 62a, 62b and springs 90, 91 flexed accordingly. Further movement beyond that shown in FIG. 5 allows pins 80a, 80b to move around the corners of the forward edges 62a, 62b into the hook portions 64a, 64b. This allows the springs to return to their normal position and the pins 80a, 80b to move inwardly into the hook recesses. This condition is shown in FIG. 6, in which the two sections are locked together. It is important to note that, depending upon the exact orientation of the two locks as they are brought together, pin 80a may snap into place in its hook portion of flange 60 prior to 80b, or both will snap in place together to complete the locking process.

In the locked position, the two locking members 50, 70 and correspondingly the edges of the two adjacent floor sections, cannot be pulled apart. This is because forces tending to move the lock apart will cause engagement surfaces 65a, and 65b to engage pins 80a, 80b and drive them into the side walls of slots 81a, 81b. This creates substantial interference and prevents withdrawal of the lock member 50. The angle or orientation of engagement surfaces 65a, 65b is chosen to be a very small angle with respect to the angle of orientation of slots 81a, 81b. In the preferred embodiment, this is approximately 10°. Specifically, in the preferred embodiment the angle A (FIG. 1) of surface 65a with respect to the floor edge is approximately 55°, and the angle B (FIG. 2) of the orientation of slot 81b is approximately 45°, so that the difference between them is approximately 10°. The only way to uncouple the locked members would be to move the pins 80*a*, 80*b* outwardly in their slots, but the angles of engagement surfaces 65*a*, 65*b* relative to the angles of slots 81*a*, 81*b*, in which pins 80*a*, 80*b* are constrained to travel, is such that the force applied does not have a sufficient component in a direction parallel to the slots to effect any such movement. Instead, most of the force is directed normal to the side walls of the slot, resulting in friction and interference, which prevents the lock from coming undone.

At the same time, the general sturdiness of the lock members and flange 60 is such that the floor sections can tolerate a considerable amount of abuse, such as attempted lifting of a floor section from one side, while its lock on the other side is still engaged to an adjacent floor section.

To release the lock, it is necessary to move pins 80*a*, 80*b* outwardly, and this is done by the flexing of springs 90, 91 to retract the pins outwardly so that they will clear the points or sides of hook portions 64*a*, 64*b* and permit withdrawal of lock member 50. Of course, if the lock is under substantial load, the release mechanism provided would not be able to move the pins, but assuming the floor sections are only under a moderate load or are simply positioned side by side with no load, the release cam 121 can accomplish the abovenoted operation.

To do so, an Allen key is inserted into the hex opening 129 in collar 122, which is accessible from the top of the floor along the edge. An approximately 90° twist on the wrench in a counter-clockwise direction (in the orientation of FIG. 6) will change the mechanism from the locked condition of FIG. 6 to the condition of FIG. 7. In FIG. 6, cam member 121 was positioned with its flat surface 124 parallel to the edge of the mechanism and springs, and the sides of notch 63 of flange 60 were bearing against surfaces 124 and 125. Rotation of the cam member with the wrench turns cam member 121 so that surfaces 125, 126 are now in contact with the side walls of notch 63, as seen in FIG. 6, and tip 123 has been rotated to push the tips of springs 90, 91 outwardly. Some movement along slot 110 is needed as the cam member is turned past the larger diameter zone between surfaces 127, 128.

Figure 9:
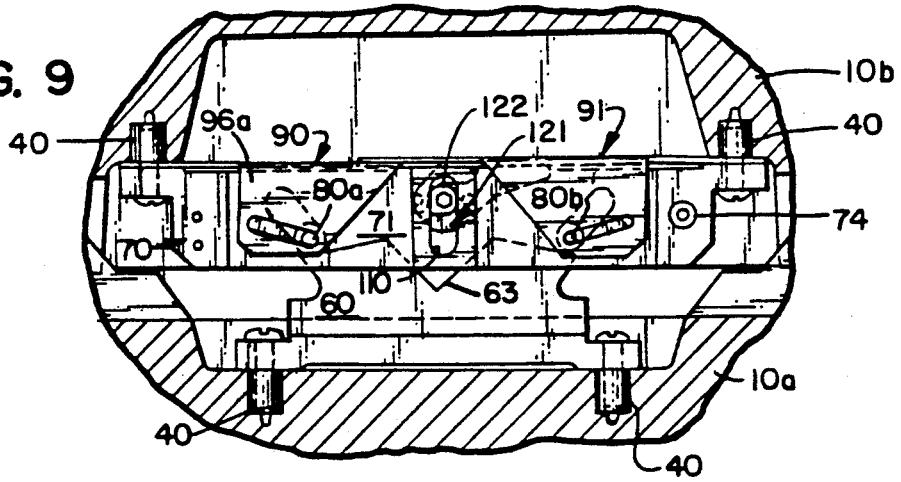
FIGS. 7, 8 and 9 are views similar to FIGS. 5 and 6, but showing the steps in unlocking of the locking mechanism.

After the mechanism has been turned to the position shown in FIG. 7, the wrench can be removed and the mechanism will stay in the position shown. It is not entirely stable in this position, but is held there as long as the two floor sections are still positioned together and the notch of flange 60 is bearing on surfaces 125 and 126 of cam member 121. Since the two pins 80*a*, 80*b* are in their retracted or open position, the two floor sections can be moved apart. When this happens, as indicated in FIG. 8, the cam member 121 initially moves outward in its slot 110 to follow flange 60 of the male lock member as it is being withdrawn. After the hook portions 64*a*, 64*b* clear the retracted pins 80*a*, 80*b*, further separation of the male and female lock members and movement of cam member 121 causes cam surface 131 (FIG. 3) to engage pin 111 of section 71 of the female lock member (FIG. 15). This causes cam member 121 to pivot slightly in a clockwise direction, as seen in FIG. 8, and the force of springs 90, 91 pushes cam member 121 to the release position shown in FIG. 9. In that position, pin 111 of half 72 of the female lock mechanism may abut surface 132 of cam member 121 to prevent it from rotating further than the position shown in FIG. 9. This prevents the tip 123 from rotating down into the slot or recess 85 where it would interfere with entry of the flange 60. In the position shown in FIG. 9, the cam member and springs have been returned to their normal position, causing pins 80*a*, 80*b* to move inwardly, and the lock is ready to receive a flange 60 for the next locking operation.

If desired, ramp-like edge members (not shown) can be provided with male or female type locking members, so that the edge members can be attached to the edges of floor sections at the edge of an extended floor area, to provide a gradual transition from the underlying floor surface to the level of the top of the portable floor surface, as is generally known.

As set forth in the foregoing description and accompanying drawings, the applicants have provided an improved locking means and improved floor section structure which provide simple operation and reliable and secure interconnection of adjacent panels.

What is claimed is:

1. A floor section adapted for edge-to-edge connection with other similar floor sections to form a temporary extended floor surface, comprising:

a generally planar rectangular core member plastic molded material encapsulating said core and forming edges around the rectangular floor section, each of said edges having recesses formed therein for receiving locking members, two of said edges having tongue portions formed therein and extending therealong, and the other two edges having complementary groove portions formed therein, and male-type locking members attached in two of said recesses, and complementary female locking members secured in the other two of said recesses, wherein said male and female lock members are configured to engage and automatically lock when said edges of said sections are fitted together, whereby a plurality of said floor sections can be secured in edge-to-edge relationship with said tongues and grooves and said male and female lock members in engagement with one another, respectively.

2. A planar section adapted for edge-to-edge connection with other similar sections, comprising:

a panel having edges around said panel adapted for edge-to-edge connection with complementary edges of similar sections, each edge having recesses formed therein and complementary first and second locking members secured in said recesses in said edges, wherein said first and second locking members are configured so that said locking members engage and automatically lock upon fitting said sections together, whereby a plurality of said sections can be secured in edge-to-edge relationships with said complementary edges and said first and second locking members in engagement with one another, respectively.

3. A planar section according to claim 2, wherein said edges have complementary tongue and groove connections for securing to other planar sections having similar tongue and groove connections.

4. A planar section according to claim 2, wherein one half of said edges have tongue connections and one half of said edges have groove connections.

5. A planar section according to claim 4, wherein one half of said edges have male locking members and one half have female locking members.

6. A planar section according to claim 2, wherein said panel has a central core panel encapsulated in a plastic molded material, and wherein said plastic molded material forms said edges.

7. A planar section according to claim 2, further comprising means for disengaging said locking members when said edges are fitted together.

8. A planar section according to claim 2, further comprising means selectively operable for disengaging said first and second locking members.

9. A planar section according to claim 2, wherein the edges have an upper surface having an aperture therethrough providing access to the selectively operable means.

10. A planar section according to claim 2, further comprising means selectively operable to permit disengagement of said first and second locking members.

11. A floor section adapted for edge-to-edge connection with other similar sections, comprising:

a panel having edges around said panel adapted for edge-to-edge connection with complementary edges of similar sections, each edge having recesses formed therein;

complementary first and second locking members secured in said recesses, wherein said first and second locking members are configured for fitting together when said complementary edges are fitted together, and wherein said locking members are configured for engaging and automatically locking upon fitting said edges together wherein said edges remain substantially parallel and the relative approach angle of each locking member to the complementary edge of an adjacent section may be up to 45° from a perpendicular approach to the complementary edge, whereby a plurality of said sections can be secured in edge-to-edge relationships with said complementary edges and said first and second locking members in engagement with one another, respectively.

12. A floor section as in claim 11, wherein said locking members engage when said section is pushed into a corner to engage other similar floor sections on two sides.

* * * * *